US012807362B2

(12) United States Patent
Ishii et al.

(10) Patent No.: US 12,807,362 B2
(45) Date of Patent: Nov. 24, 2026

(54) SYNTHETIC RESIN CONTAINER

(71) Applicant: YOSHINO KOGYOSHO CO., LTD., Tokyo (JP)

(72) Inventors: Yusuke Ishii, Tokyo (JP); Yuichi Okuyama, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 40 days.

(21) Appl. No.: 18/685,143

(22) PCT Filed: Aug. 9, 2022

(86) PCT No.: PCT/JP2022/030479

§ 371 (c)(1),
(2) Date: Feb. 20, 2024

(87) PCT Pub. No.: WO2023/074084

PCT Pub. Date: May 4, 2023

(65) Prior Publication Data

US 2024/0359856 A1 Oct. 31, 2024

(30) Foreign Application Priority Data

Oct. 29, 2021 (JP) ..... 2021-178255

(51) Int. Cl.
*B65D 1/02* (2006.01)

(52) U.S. Cl.
CPC ..... *B65D 1/0223* (2013.01); *B65D 1/0207* (2013.01); *B65D 2501/0018* (2013.01)

(58) Field of Classification Search
CPC ..... B65D 1/0223; B65D 1/0207; B65D 2501/0018; B65D 2501/0036
See application file for complete search history.

(56) References Cited

U.S. PATENT DOCUMENTS

2015/0336320 A1* 11/2015 Poulat ..... B29C 49/4823 425/526
2019/0077535 A1 3/2019 Okuyama et al.
(Continued)

FOREIGN PATENT DOCUMENTS

CN 110099853 A 8/2019
JP H11-105846 A 4/1999
(Continued)

OTHER PUBLICATIONS

May 7, 2025 Office Action issued in Japanese Patent Application No. 2021-178255.
(Continued)

*Primary Examiner* — Chun Hoi Cheung
*Assistant Examiner* — Sanjidul Islam
(74) *Attorney, Agent, or Firm* — Oliff PLC

(57) ABSTRACT

A synthetic resin container that includes a mouth, a body and a bottom, wherein the body includes: an upper end portion; a lower end portion; and an intermediate portion with a polygonal cross-sectional shape having, at vertices thereof, 6 to 12 inclined ridge lines spirally extending around the axis line with a twist angle of 30° or more and 90° or less, the intermediate portion being disposed between the upper end portion and the lower end portion, and wherein when a width of a portion of the body with a greatest diameter is W, and a height from ground to a boundary between the shoulder and the body is H, the synthetic resin container has a shape that satisfies W/H=0.20 to 0.35.

8 Claims, 3 Drawing Sheets

(56) References Cited

U.S. PATENT DOCUMENTS

| | | | | |
|---|---|---|---|---|
| 2019/0291328 | A1 | 9/2019 | Finger et al. | |
| 2020/0047395 | A1* | 2/2020 | Okuyama | B29C 49/06 |
| 2020/0095010 | A1 | 3/2020 | Kira et al. | |

FOREIGN PATENT DOCUMENTS

| | | | | |
|---|---|---|---|---|
| JP | 2006-335357 | A | | 12/2006 |
| JP | 4452475 | B2 | | 4/2010 |
| JP | 5057305 | B2 | | 10/2012 |
| JP | 2014037269 | | * | 2/2014 |
| JP | 2014-073849 | A | | 4/2014 |
| JP | 2016-011156 | A | | 1/2016 |
| JP | 2016-020240 | A | | 2/2016 |
| JP | 2018-030629 | A | | 3/2023 |
| WO | 2014/095386 | A1 | | 6/2014 |
| WO | 2018/123944 | A1 | | 7/2018 |
| WO | 2020/079122 | A1 | | 4/2020 |

OTHER PUBLICATIONS

Oct. 25, 2022 International Search Report issued in International Patent Application No. PCT/JP2022/030479.

Apr. 30, 2024 International Preliminary Report on Patentability issued in International Patent Application No. PCT/JP2022/030479.

Aug. 1, 2025 Office Action issued in Chinese Patent Application No. 202280058608.2.

Sep. 9, 2025 Office Action issued in Japanese Patent Application No. 2021-178255.

Jan. 9, 2026 Extended Search Report issued in European Patent Application No. 22886418.7.

Jan. 27, 2026 Office Action issued in Chinese Patent Application No. 202280058608.2.

Mar. 20, 2026 Office Action issued in Chinese Patent Application No. 202280058608.2.

* cited by examiner

SYNTHETIC RESIN CONTAINER

TECHNICAL FIELD

The present disclosure relates to a synthetic resin container that includes a tubular mouth, a body connected to the mouth via a shoulder, and a bottom closing a lower end of the body.

BACKGROUND

Synthetic resin containers, typical examples of which include polypropylene (PP) bottles and polyethylene terephthalate (PET) bottles, have been used for various purposes, such as beverages, food, or cosmetics, because they are lightweight and easy to handle, have excellent storage stability of the contents, and are inexpensive.

Such a synthetic resin container is distributed in the market after the mouth is closed with a cap in a state in which it is filled with the contents. However, for example in summer, when the synthetic resin container is distributed and stored in a high-temperature environment (40° C. to 50° C.) and is used in a cooled state, the inside of the container may decompress, and the body of the container may deform into a distorted shape, thus resulting in appearance defects.

Therefore, a synthetic resin container has been developed in which the body is shaped as a polygonal shape having, at its vertices, a plurality of spirally extending inclined ridge lines, so that torsional deformation of the body absorbs decompression inside the container to thereby reduce appearance defects (refer to Patent Literature 1, for example).

CITATION LIST

Patent Literature

PTL 1: JP 4452475 B2

SUMMARY

Technical Problem

However, even in the above existing synthetic resin container, torsional deformation of the body cannot sufficiently absorb decompression, and there is a need for an improved synthetic resin container.

It would be helpful to provide a synthetic resin container capable of more reliably preventing appearance defects caused by decompression and deformation of the body.

Solution to Problem

A synthetic resin container according to the present disclosure is a synthetic resin container that includes a tubular mouth, a body connected to the mouth via a shoulder, and a bottom closing a lower end of the body, wherein the body includes:

an upper end portion with a circular cross-sectional shape centered on an axis line;

a lower end portion with a circular cross-sectional shape centered on the axis line; and an intermediate portion with a polygonal cross-sectional shape having, at vertices thereof, 6 to 12 inclined ridge lines spirally extending around the axis line with a twist angle of 30° or more and 90° or less, the intermediate portion being disposed between the upper end portion and the lower end portion, and wherein when a width of a portion of the body with a greatest diameter is W, and a height from ground to a boundary between the shoulder and the body is H, the synthetic resin container has a shape that satisfies W/H=0.20 to 0.35.

In a preferred embodiment of the synthetic resin container configured as above, the body has a shape in which a width thereof gradually decreases from the upper end portion toward the lower end portion.

In another preferred embodiment of the synthetic resin container configured as above, the inclined ridge lines each have a shape in which a circumferential width thereof is maximum in a middle portion between the upper end portion and the lower end portion and in which the circumferential width gradually decreases from the middle portion toward the upper end portion and the lower end portion.

In yet another preferred embodiment of the synthetic resin container configured as above, the synthetic resin container is a liquid blow molded product.

Advantageous Effect

According to the present disclosure, a synthetic resin container capable of more reliably preventing appearance defects caused by decompression and deformation of the body can be provided.

DETAILED DESCRIPTION

In the following, the present disclosure will be illustrated more concretely with reference to the drawings.

Figure 1:
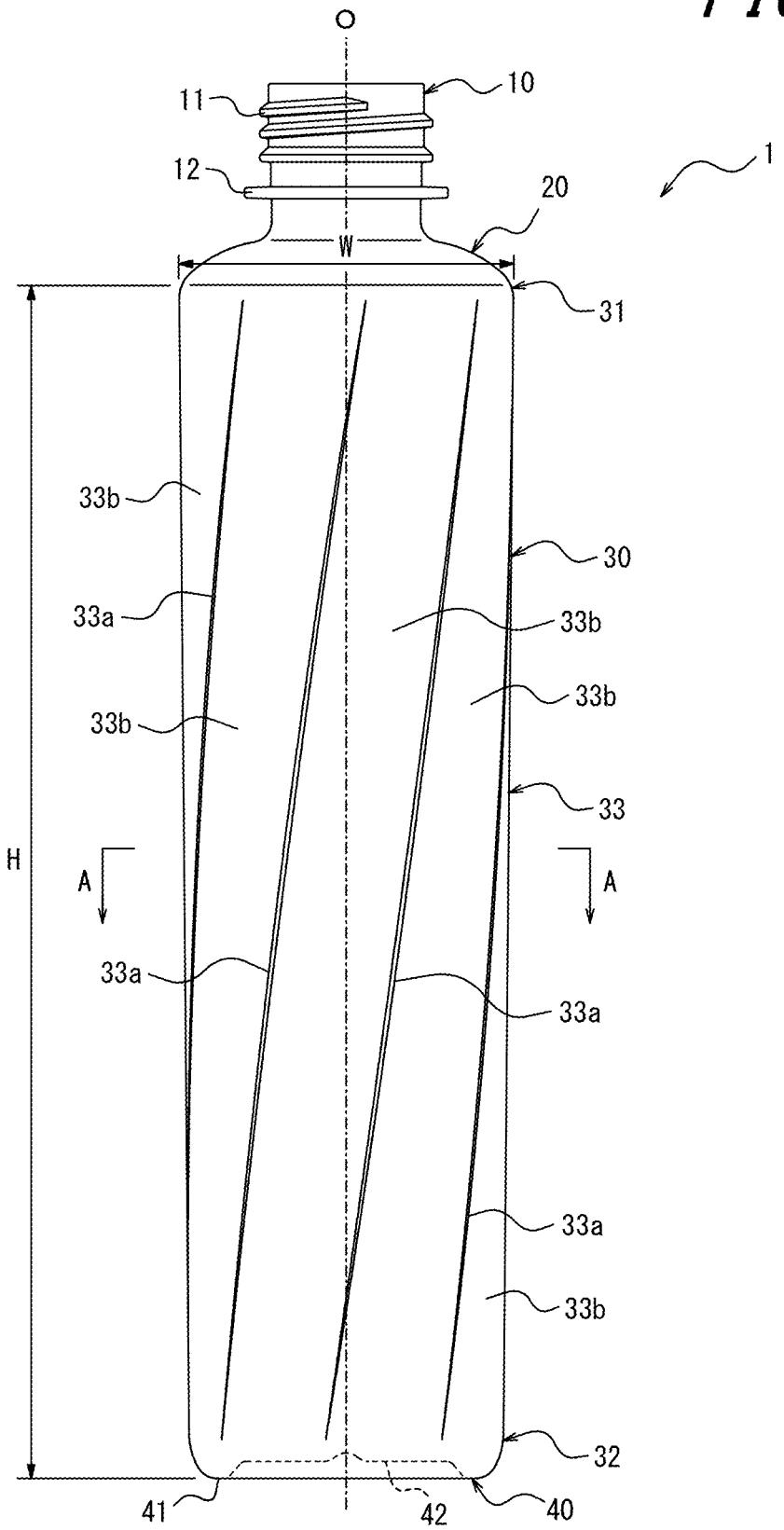
FIG. 1 is front view illustrating a synthetic resin container according to an embodiment of the present disclosure.
Figure 2:
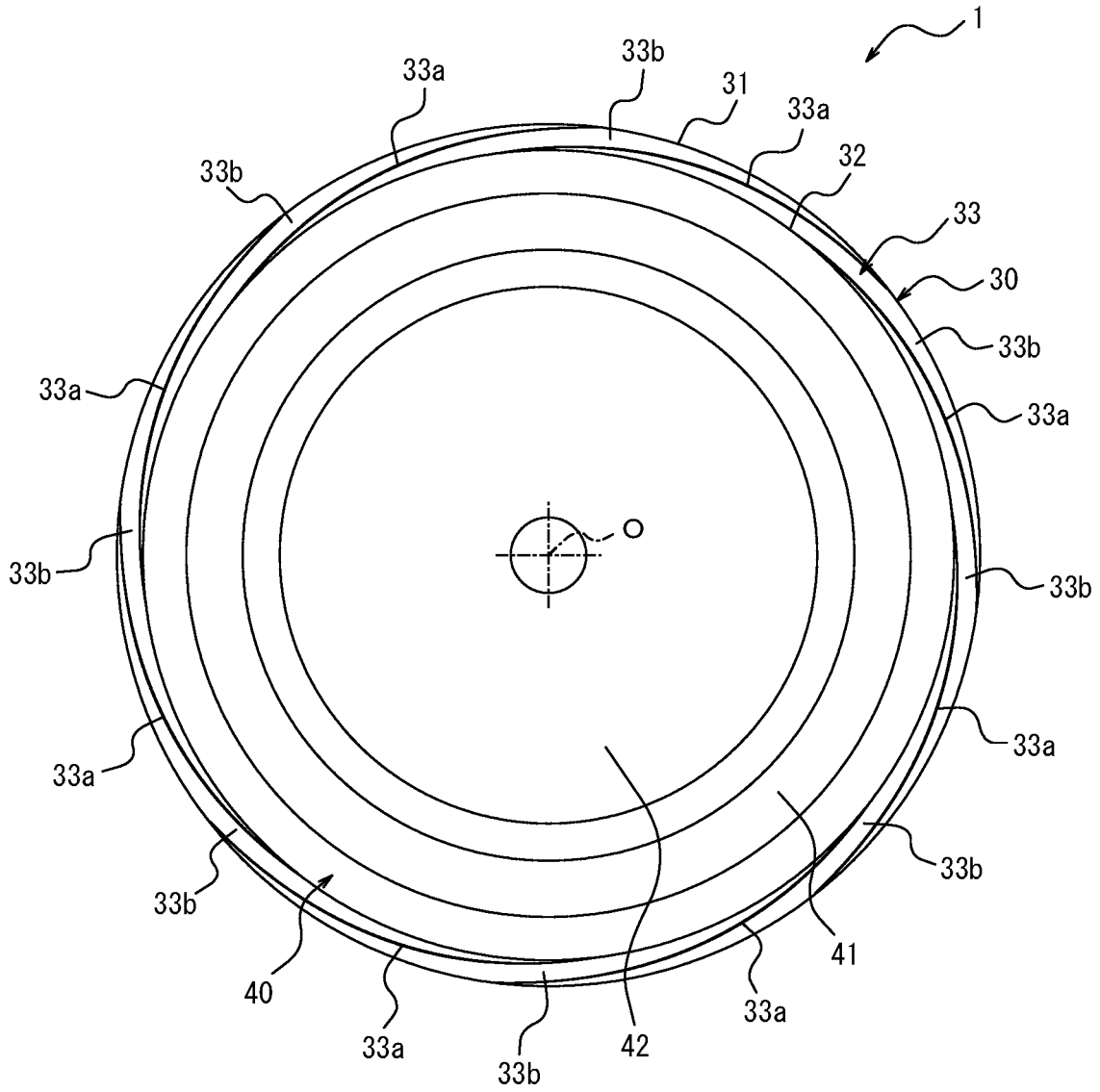
FIG. 2 is a bottom view illustrating the synthetic resin container of FIG. 1.

A synthetic resin container 1 according to an embodiment of the present disclosure as illustrated in FIG. 1 and FIG. 2 is used, for example, to contain contents, such as beverages, seasonings, detergents, or cosmetics.

The synthetic resin container 1 can be made of, for example, polypropylene (PP) or polyethylene terephthalate (PET), but may also be made of other synthetic resins.

The synthetic resin container 1 has a bottle shape with a mouth 10, a shoulder 20 connected to a lower end of the mouth 10, a body 30 connected to the mouth 10 via the shoulder 20, and a bottom 40 closing a lower end of the body 30. Additionally, reference numeral O represents an axis line common to the mouth 10, the shoulder 20, the body 30, and the bottom 40.

In the present description and the claims, a vertical direction refers to a vertical direction (direction in which the axis line O extends) in a state in which the synthetic resin container 1 is in an upright position as illustrated in FIG. 1, and a radial direction refers to a direction passing through the axis line O of the synthetic resin container 1 and perpendicular to the axis line O.

The mouth 10 has a substantially cylindrical shape centered on the axis line O, and the mouth 10 is integrally provided, on an outer peripheral surface thereof, with a male thread 11, to which a closure member, such as a cap, can be attached. Furthermore, the mouth 10 is integrally provided, on a lower side than the male thread 11, with a neck ring 12.

The mouth 10, which has a tubular shape, is not limited to a cylindrical shape and may be, for example, a square tube shape or an elliptical tube shape. The mouth 10 can also be configured to be provided, on the outer peripheral surface, with a projection onto which a closure member, such as a cap, can be pressed by undercut engagement, instead of the male thread 11. The mouth 10 can also be configured without the neck ring 12.

The shoulder 20 has a substantially dome shape that is convex toward an outer side of the container, and it is integrally connected to the lower end of the mouth 10. The shape of a section of the lower end of the shoulder 20 that is perpendicular to the axis line O, that is, its cross-sectional shape, is a circular shape.

The shape of the shoulder 20 is not limited to the substantially dome shape, but can be changed in various ways, for example, to an umbrella shape inclined in a straight line.

The body 30 is has a tubular shape extending along the axis line O as a whole. The body 30 has an upper end portion 31, a lower end portion 32, and an intermediate portion 33 disposed between the upper end portion 31 and the lower end portion 32.

The upper end portion 31 is a portion that forms an upper end of the body 30. The shape of a section of the upper end portion 31 that is perpendicular to the axis line O, that is, its cross-sectional shape, is a circular shape, and it is integrally connected to the lower end of the shoulder 20.

The lower end portion 32 is a portion that forms a lower end of the body 30, and the shape of a section perpendicular to the axis line O, that is, its cross-sectional shape, is a circular shape centered on the axis line O.

As illustrated in FIG. 2, in the present embodiment, an outer diameter of the upper end portion 31 that is centered on the axis line O is greater than an outer diameter of the lower end portion 32 that is centered on the axis line O. As a result, the body 30 has a shape in which the width gradually decreases from the upper end portion 31 toward the lower end portion 32.

Figure 3:
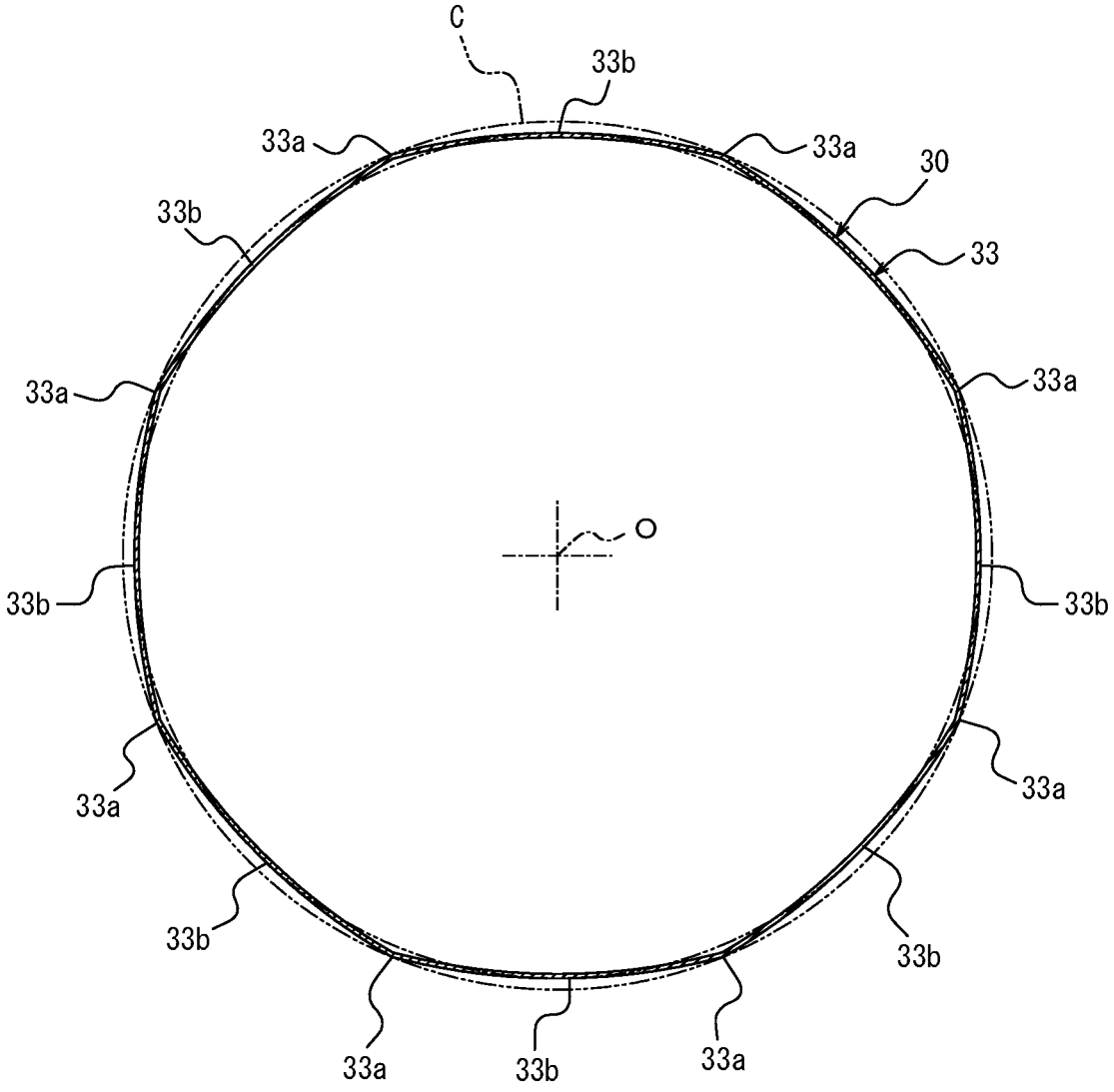
FIG. 3 is a sectional view along line A-A of FIG. 1.

The intermediate portion 33 has 6 to 12 inclined ridge lines 33*a*, each of which spirally extends around the axis line O with a twist angle of 30° or more and 90° or less from the upper end portion 31 to the lower end portion 32. As illustrated in FIG. 3, with the plurality of inclined ridge lines 33*a*, the shape of a section of the intermediate portion 33 that is perpendicular to the axis line O, that is, its cross-sectional shape, is a polygonal shape having the inclined ridge lines 33*a* at the vertices.

In the present embodiment, the intermediate portion 33 has 8 inclined ridge lines 33*a*, each of which spirally extends around the axis line O with a twist angle of 45°. The respective inclined ridge lines 33*a* are disposed side by side with equal spacing in a circumferential direction centered on the axis line O. As a result, the cross-sectional shape of the intermediate portion 33 is a regular octagonal shape having the 8 inclined ridge lines 33*a* at the vertices.

Additionally, a "twist angle" is an angle formed by a straight line connecting the axis line O and an upper end of an inclined ridge line 33*a* and a straight line connecting the axis line O and a lower end of the inclined ridge line 33*a*, as viewed from the direction along the axis line O.

In the present embodiment, each inclined ridge line 33*a* has a shape in which the width in the circumferential direction centered on the axis line O, that is, the circumferential width, is maximum in a middle portion (middle portion in the vertical direction) between the upper end portion 31 and the lower end portion 32, and the circumferential width gradually decreases from the middle portion toward the upper end portion 31 and the lower end portion 32.

Furthermore, in the present embodiment, in a cross-section perpendicular to the axis line O, each inclined ridge line 33*a* has a shape in which the tip portion facing outward in the radial direction is curved with a radius smaller than an imaginary circle C that is centered on the axis line O and that passes through the vertices of the 8 inclined ridge lines 33*a* facing outward in the radial direction, and in which the tip portion facing outward in the radial direction is chamfered. The chamfered portion has a circumferential width corresponding to the circumferential width of the inclined ridge line 33*a*. The circumferential width of the chamfered portion of the inclined ridge line 33*a* is preferably 1 mm or less in the middle portion between the upper end portion 31 and lower end portion 32 in which the circumferential width of the inclined ridge line 33*a* is maximum, and in the present embodiment, it is 0.6 mm. Additionally, the chamfered tip portion of the inclined ridge line 33*a* preferably has a flat shape or a curved shape curved convexly outward in the radial direction.

Portions of the intermediate portion 33 that are located between respective two adjacent inclined ridge lines 33*a* form panel portions 33*b*. Although the cross-sectional shape of the panel portions 33*b* is a curved shape curved convexly outward in the radial direction with a radius greater than the imaginary circle C, it may also be a flat shape.

The intermediate portion 33 has a shape in which the overall width decreases from the upper end toward the lower end, so that the imaginary circle C, which is centered on the axis line O and which passes through the vertices of the 8 inclined ridge lines 33*a* facing outward in the radial direction, has the same diameter as the upper end portion 31 at the upper ends of the inclined ridge lines 33*a*, gradually decreases in diameter from the upper ends toward the lower ends, and has the same diameter as the lower end portion 32 at the lower ends.

As illustrated in FIG. 1, the body 30 with the above configuration has an elongated shape in the vertical direction that satisfies the following conditions. That is, when the dimension in the radial direction of the upper end portion 31, that is, its width corresponding to the portion of the body 30 with the greatest diameter (the widest portion in the side view), is W, and when the dimension in the direction along the axis line O from the ground to a boundary between the shoulder 20 and the body 30, that is, its height, is H, W/H=0.2 to 0.35. In the present embodiment, the width W of the body 30 is 39.5 mm, the height His 141.0 mm, and W/H is 0.28.

Additionally, the inner capacity of the synthetic resin container 1 is preferably from 120 ml to 200 ml.

The bottom 40 has an annular ground-contacting portion 41 and a concave portion 42 disposed inward in the radial direction of the ground-contacting portion 41. The bottom 40 is disposed to be integrally connected to the lower end portion 32 of the body 30, so as to close the lower end of the body 30. A lower end of the ground-contacting portion 41 is reference ground for the height H.

The synthetic resin container 1 according to the present embodiment is a liquid blow molded product. That is, the synthetic resin container 1 is formed by blow molding a synthetic resin preform formed in a bottomed cylindrical shape, for example, using liquid as a pressurizing medium. By using, as the pressurizing medium, liquid that is to be ultimately filled into the synthetic resin container 1 as the contents, the blow molding and the filling of the contents can be performed simultaneously, whereby the liquid-filled synthetic resin container 1 can be easily formed.

Additionally, the synthetic resin container 1 is not limited to a liquid blow molded product, and can also be formed by various manufacturing methods, such as air blow molding using air as the pressurizing medium, or extrusion blow molding (EBM) using a tubular parison made of synthetic resin. In these cases, after forming the synthetic resin container 1, the inside is filled with the contents.

In the synthetic resin container 1 with the above configuration, in a state in which it is filled with the contents and the mouth 10 is closed with a closure member, such as a cap, when the inside of the container is brought into a decompressed state, the body 30 or the intermediate portion 33 is twisted in a direction that increases the twist angle of the plurality of inclined ridge lines 33*a* or panel portions 33*b*, thereby absorbing the decompression. This prevents the body 30 from being deformed into a distorted shape due to decompression and deformation and also prevents the occurrence of localized depressions. Thus, according to the synthetic resin container 1 of the present embodiment, even when the inside of the container is in a decompressed state, appearance defects of the body 30 due to decompression and deformation can be prevented.

Here, in the synthetic resin container 1 according to the present embodiment, the body 30 has a vertically elongated shape in which the relationship between the width W and the height H of the body 30 satisfies W/H=0.20 to 0.35, and the intermediate portion 33 disposed between the upper end portion 31 and the lower end portion 32 of the body 30 has a polygonal cross-sectional shape having, at the vertices, 6 to 12 inclined ridge lines 33*a* spirally extending around the axis line O with a twist angle of 30° or more and 90° or less. This further ensures that the body 30 can be prevented from being unwantedly deformed due to decompression and deformation, without having to significantly reduce the inner capacity of the synthetic resin container 1, compared to a case in which the body 30 is formed in an ordinary cylindrical shape.

When the number of inclined ridge lines 33*a* disposed in the intermediate portion 33 is less than 6, sufficient inner volume of the synthetic resin container 1 cannot be achieved in comparison with a case in which the body 30 is formed in a cylindrical shape, thus resulting in insufficient inner capacity. Conversely, when the number of inclined ridge lines 33*a* disposed in the intermediate portion 33 is greater than 12, the strength of the intermediate portion 33 becomes too high, and decompression cannot be absorbed sufficiently by torsional deformation, thus possibly resulting in appearance defects of the body 30 due to decompression and deformation.

Furthermore, in the present embodiment, the plurality of panel portions 33*b* each have a curved shape curved convexly outward in the radial direction in the cross-sectional view. Accordingly, sufficient inner capacity of the synthetic resin container 1 can be achieved.

Moreover, in the present embodiment, the plurality of inclined ridge lines 33*a* each have a shape in which the circumferential width is maximum in the middle portion between the upper end portion 31 and the lower end portion 32 and in which the circumferential width gradually decreases from the middle portion toward the upper end portion 31 and the lower end portion 32. This prevents plastic deformation of the inclined ridge lines 33*a* into a concave shape or the like due to external force.

Moreover, in the present embodiment, the body 30 has a shape in which the width gradually decreases from the upper end portion 31 toward the lower end portion 32. Accordingly, in a case in which the synthetic resin container 1 is inserted into an outer container (not shown), the synthetic resin container 1 can be easily inserted into the outer container from an upper end opening of the outer container. Besides, the rattling of the synthetic resin container 1 against the outer container can be reduced.

Moreover, in the present embodiment, the synthetic resin container 1 is a liquid blow molded product formed by liquid blow molding. Accordingly, compared to a case in which the container is formed by air blow molding, the dimensional accuracy of the synthetic resin container 1 with the above configuration can be improved, by enhancing formability during blow molding. This allows each part of the synthetic resin container 1 to reliably demonstrate the above effect, thereby more effectively preventing appearance defects caused by decompression and deformation of the body 30, while the inner capacity of the synthetic resin container 1 is achieved.

Needless to say, the present disclosure is not limited to the above embodiment, and various modifications can be made without departing from the gist of the present disclosure.

For example, although in the above embodiment the body 30 has a shape in which the width gradually decreases from the upper end portion 31 toward the lower end portion 32, the present disclosure is not limited to this embodiment. The body 30 may have a shape in which the width is constant from the upper end portion 31 to the lower end portion 32.

Similarly, although in the above embodiment the plurality of inclined ridge lines 33*a* each have a shape in which the circumferential width is maximum in the middle portion between the upper end portion 31 and the lower end portion 32, and the circumferential width gradually decreases from the middle portion toward the upper end portion 31 and the lower end portion 32, the present disclosure is not limited to this embodiment. The plurality of inclined ridge lines 33*a* may each have a shape in which the circumferential width is constant from the upper end to the lower end. Furthermore, the plurality of inclined ridge lines 33*a* may each be configured so that no chamfered portion is provided at the tip facing outward in the radial direction.

REFERENCE SIGNS LIST

1 Synthetic resin container
10 Mouth
11 Male thread
12 Neck ring
20 Shoulder
30 Body
31 Upper end portion
32 Lower end portion
33 Intermediate portion
33*a* Inclined ridge line
33*b* Panel portion
40 Bottom
41 Ground-contacting portion
42 Concave portion
O Axis line
C Imaginary circle
W Overall width
H Overall height

The invention claimed is:

1. A synthetic resin container that includes a tubular mouth, a body connected to the mouth via a shoulder, and a bottom closing a lower end of the body, wherein the shoulder has a dome shape that is convex toward an outer side of the container;

the body comprises:

an upper end portion with a circular cross-sectional shape centered on an axis line, the upper end portion being integrally connected to a lower end of the shoulder at a first plane that defines a first boundary at which the shoulder begins to curve inward toward the axis line;

a lower end portion with a circular cross-sectional shape centered on the axis line, the lower end portion being integrally connected to the bottom at a second plane that defines a second boundary at which the bottom begins to curve inward toward the axis line, the bottom continuously curving inward toward the axis line while proceeding from the second plane to a ground-contacting portion of the bottom; and an intermediate portion extending from the first plane to the second plane, the intermediate portion including 6 to 12 inclined ridge lines spirally extending around the axis line with a twist angle of 30° or more and 90° or less, each ridge line contacting the upper end portion at the first plane and contacting the lower end portion at the second plane, each cross section of the intermediate portion along the axis line having a cross-sectional shape, in a cross section perpendicular to the axis line, that has vertices that correspond to the ridge lines, the cross-sectional shape having (i) a single straight line connecting each pair of adjacent ones of the vertices or (ii) a single curved line connecting each pair of adjacent ones of the vertices, each curved line curving outward with respect to the axis line.

2. The synthetic resin container according to claim 1, wherein the body has a shape in which a width thereof gradually decreases from the upper end portion toward the lower end portion.

3. The synthetic resin container according to claim 1, wherein the inclined ridge lines each have a shape in which a circumferential width thereof is maximum in a middle portion between the upper end portion and the lower end portion and in which the circumferential width gradually decreases from the middle portion toward the upper end portion and the lower end portion.

4. The synthetic resin container according to claim 1, wherein the synthetic resin container is a liquid blow molded product.

5. The synthetic resin container according to claim 2, wherein the inclined ridge lines each have a shape in which a circumferential width thereof is maximum in a middle portion between the upper end portion and the lower end portion and in which the circumferential width gradually decreases from the middle portion toward the upper end portion and the lower end portion.

6. The synthetic resin container according to claim 2, wherein the synthetic resin container is a liquid blow molded product.

7. The synthetic resin container according to claim 3, wherein the synthetic resin container is a liquid blow molded product.

8. The synthetic resin container according to claim 5, wherein the synthetic resin container is a liquid blow molded product.

* * * * *